United States Patent [19]

Hashimoto et al.

[11] 4,387,269

[45] Jun. 7, 1983

[54] ELECTRONIC APPARATUS WITH SPEECH SYNTHESIZER

[75] Inventors: Shintaro Hashimoto, Ikoma; Akitaka Morita, Nara; Hiroshi Tsuda, Uji, all of Japan

[73] Assignee: Sharp Kabushiki Kaisha, Osaka, Japan

[21] Appl. No.: 239,545

[22] Filed: Mar. 2, 1981

[30] Foreign Application Priority Data

Mar. 3, 1980 [JP] Japan ..... 55-27174

[51] Int. Cl.[3] ..... G10L 1/00

[52] U.S. Cl. ..... 179/1 SM; 364/513

[58] Field of Search ..... 179/1 SM, 1 SC; 340/636; 364/707, 513; 307/362

[56] References Cited

U.S. PATENT DOCUMENTS 4,271,404 6/1981 Tanaka ..... 364/707

4,272,649 6/1981 Pfeiffer ..... 179/1 SM 4,296,338 10/1981 Thomas ..... 340/636

4,317,181 2/1982 Teza et al. ..... 364/707

*Primary Examiner*—Emmanuel S. Kemeny

*Attorney, Agent, or Firm*—Birch, Stewart, Kolasch and Birch

[57] ABSTRACT

An electronic apparatus includes a speech synthesizer, a speech synthesis controller, and a microprocessor connected to the speech synthesis controller. The microprocessor controls transmission of sound-related data from the microprocessor to the speech synthesis controller, receives control signals from the sound synthesis controller to said microprocessor and monitors the voltage supplied to the speech synthesis controller. For this purpose the microprocessor is responsive to an output signal indicative of a variation in the voltage for controlling the sound signal delivery operation of the speech synthesis controller.

5 Claims, 8 Drawing Figures

ELECTRONIC APPARATUS WITH SPEECH SYNTHESIZER

BACKGROUND OF THE INVENTION

This invention relates to an electronic apparatus associated with a speech synthesizer and more particularly to a device which provides control for synthesis of speech.

As is well known, the speech synthesizer has many applications including for example, an electronic calculator which provides audible indications of calculation formula and the results of calculations, a timepiece which audibly announces updated time of the day or alarm settings, a vending machine which delivers instructions such as deposit of coins and selection of buttons in the form of human voices and an automobile which provides audible warnings indicative of a symptom or possible trouble for the driver. It is therefore expected that the speech synthesizer will be in wide use in a variety of industries.

A voice synthesis controller, a major component of the speech synthesizer, is implemented with a one-chip LSI device, which controller contains a control memory and a sound-related data memory. The contents of the sound-related data are fetched pursant to instructions stored in the control memory for synthesis of speech. Pre-stored words can be delivered in an audible form under certain conditions by the speech synthesizer alone. In the case where a microprocessor is adapted to govern the speech synthesis controller and also has the function of a timepiece or a calculator, the controller can deliver audible indications of timekeeping information or the results of calculations while being supplied wth word codes indicative of the timekeeping information or the results of calculations. However, it is possible that the above-discussed speech synthesizers may produce wrong or nonrelevant sounds upon a decline of an enabling voltage therefor. There is thus a requirement for monitoring fluctuations in the enabling voltage and preventing wrong or nonrelevant indications from being delivered.

OBJECTS AND SUMMARY OF THE INVENTION

Accordingly, it is an object of the present invention to provide an electronic apparatus associated with a speech synthesizer which monitors fluctuations of or an extraordinary high or low level of an enabling voltage supplied to a component or components in a sound-related section thereof through the utilization of information control means included in a speech synthesis controller.

In accordance with a preferred aspect of the present invention, there is provided an electronic apparatus which comprises a speech synthesis controller including a sound-related data memory, a control memory for storing instructions for governing the procedure of fetching the contents of said sound-related data memory and control means, and a microprocessor connected to said speech synthesis controller. The microprocessor comprises output means for controlling transmission of sound-related data from said microprocessor to said speech synthesis controller and for feeding control signals from said sound synthesis controller to said microprocessor, which output means further including means for monitoring an enabling voltage supplied to said speech synthesis controller. The microprocessor further includes means responsive to an output signal indicative of a variation in said enabling voltage and developed from said output means for controlling the sound signal delivery operation of said speech synthesis controller.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
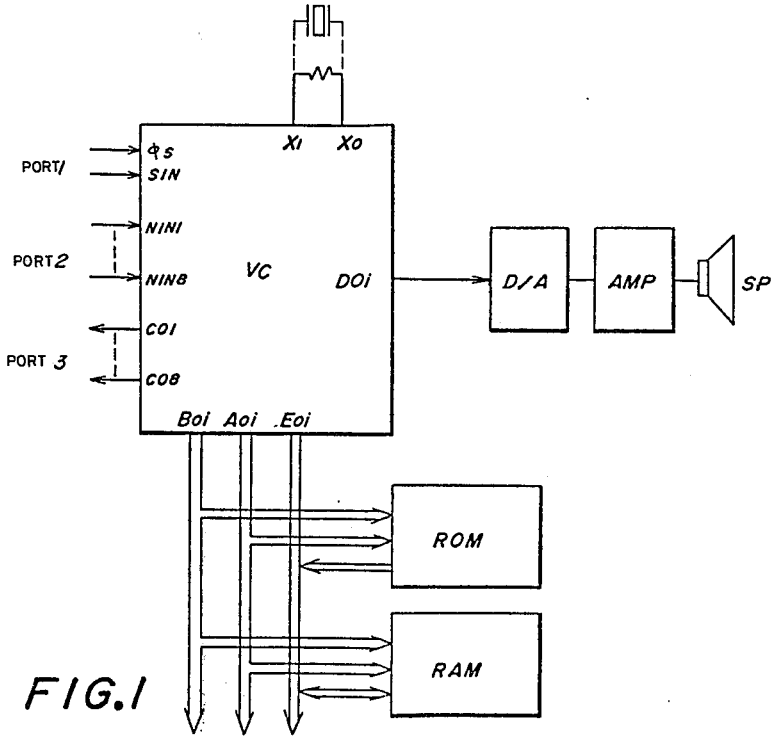
FIGS. 1 and 2 are block diagrams of a speech synthesizer according to the present invention.

Referring now to FIG. 1, there is illustrated a speech synthesizer controller VC which is implemented with a one-chip LSI semiconductor device having a plurality of external terminals. Terminals $X_I$ and $X_O$ are connected to a quartz oscillator or a resistor for exciting a built-in clock generator in the interior of VC. Port I is used to serially introduce data (for example, 8 bit data). The data are applied to terminal $S_{IN}$ and data latch clock pulses are applied to terminal $\phi_S$. When the data are 8 bits long, data are applied to the input terminal $S_{IN}$ eight times. The signals are supplied to $\phi_S$ to maintain the introduction of such bit data in a predetermined timed relationship.

Port 2 is a multi-purpose input port for introduction of 8 bit data or control signals from an external LSI device (typically, CPU) or the like. Port 3 is a multi-purpose 8-bit output port from which 8-bit data and control signals are delivered to the external LSI device (CPU) or the like. An address bus $AO_i$, combined with another bus $BO_i$, form a 16-bit bus which leads address data to an external expansion memory.

8-bit data bus $EO_i$ which is common to inputs and outputs is used to supply the data to the expansion memories (ROM and RAM) and receive the data from these memories. It is well known that the above-mentioned ROM is a read only memory and the RAM is a read and write memory. An audible output port $DO_i$ provides 6-bit digital outputs and 2-bit pulse width modulated (PWM) outputs. In other words, digital sound information from the speech synthesizer controller VC may be outputted through pulse width modulation. If the port $DO_i$ is used to provide the sound outputs, these outputs are converted into analog sound information via a low-pass filter. There is further provided a digital-to-analog converter D/A, an amplifier AMP and a loud speaker SP.

In the case of the pulse width modulated (PWM) outputs, additional output terminals may provide 2-bit long PWM signals of opposite polarities from those noted above. Therefore, the polarity of the output signals is optionally selectable without phase reversal by an external sound amplifier. It is to be understood that the digital-to-analog converter is unnecessary for the pulse width modulated outputs.

As an alternative, when the 6-bit digital signals (without the 2-bit PWM terminals) are used as the audible outputs, the digital-to-analog converter D/A converts these digital signals into corresponding analog signals, thus providing the audible outputs. In the case where the digital signals and the pulse width modulated signals are both available in the speech synthesizer, there is the possibility to properly use externally connected circuits, parts and quality of sounds depending on the intended use of the speech synthesizer.

Figure 2:
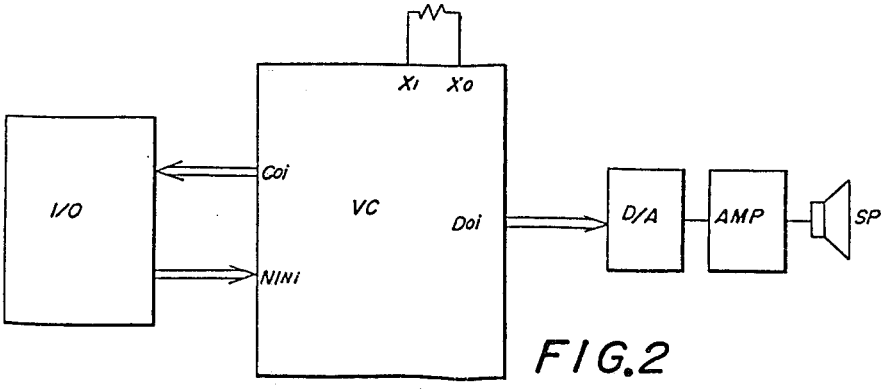
Figure 3:
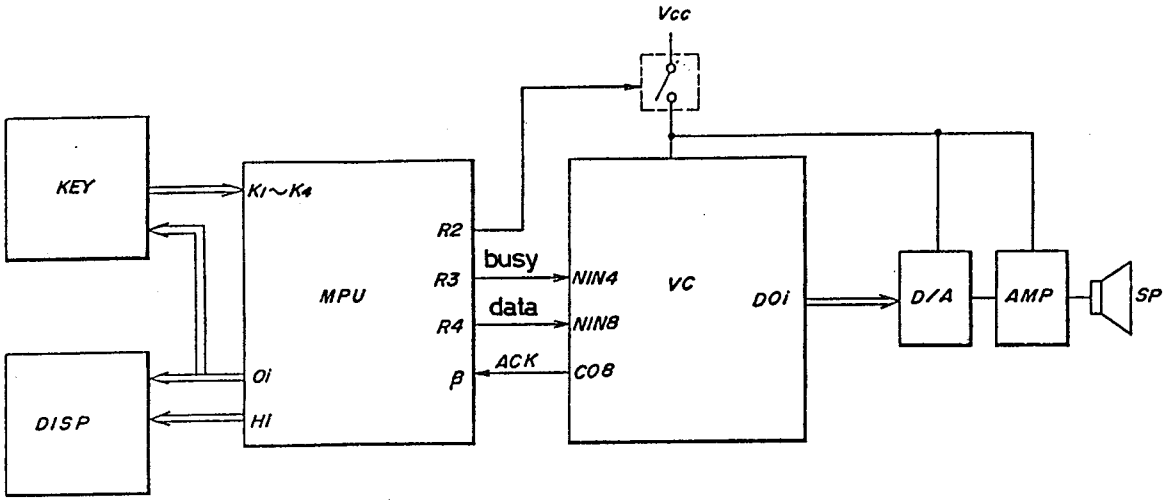
FIG. 3 is a block diagram showing the speech synthesizer coupled with a microprocessor.

With reference to FIGS. 2 and 3, the following description will go into details of the speech synthesizer. An input/output I/O comprises a well-known keyboard and a display such as a liquid crystal display panel. For example, strobe signals are delivered from $CO_1$–$CO_4$ of the output port $CO_i$ and key inputs are introduced via a matrix in combination with the input port $N_{INi}$. A combination of signals from $CO_1$–$CO_4$ and $CO_5$—$CO_8$ enables the display. Upon actuation of a particular key corresponding lamps in the display are energized. This function is useful in relatively small utilizing equipment where all that is necessary is to provide synthesized sounds indicative of preselected words only.

FIG. 3 is a block diagram of the speech synthesizer which is connected to a microprocessor. This microprocessor is labeled MPU with terminals $K_1$—$K_4$ connected to the keyboard KEY. An output port $O_i$ supplies the strobe signals to the keyboard KEY and segment enabling signals to the display DISP. Moreover, an output port $H_i$ provides a common signal for the display DISP.

These components, the microprocessor MPU, the keyboard KEY and the display DISP may perform the functions of an electronic calculator and, when combined with the speech synthesizer embodying the present invention, provide audible synthesized outputs indicative of the introduced key signals or the results of calculations.

More particularly, an enabling voltage is supplied from a terminal $R_2$ of the microprocessor MPU to the speech synthesizer controller VC, the digital-to-analog converter D/A and the amplifier AMP. Then, the microprocessor MPU delivers the audio data to be outputted in the form of synthesized sounds by means of the speech synthesizer controller VC. These data are word codes stored within a memory. For example, when delivery of an audible output indicative of an instruction (X: multiply) is desirable, the microprocessor MPU feeds a code indicative of the word "multiply" to the controller VC.

The data are outputted in a serial fashion from a terminal $R_4$ of the processor MPU to $N_{IN8}$ of the input port $N_{INi}$ of the controller VC. To maintain transmission of the data in a proper timed relationship, a busy signal is supplied from a terminal $R_3$ of the microprocessor MPU to a terminal $N_{IN4}$ of the controller VC and an acknowledge (ACK) signal is fed from the terminal $CO_8$ of the output port $CO_i$ of the controller VC to a terminal $\beta$ of the microprocessor MPU. Through exchange between of the BUSY signal and ACK signal data transmission is executed in a well-known manner.

Figure 4:
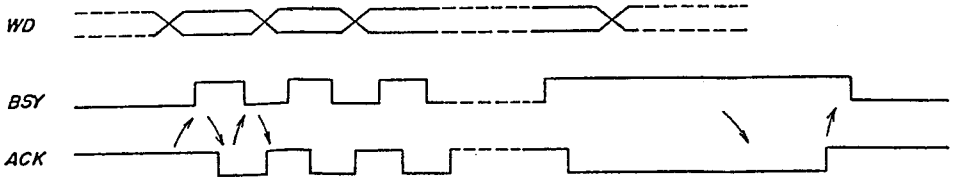
FIG. 4 is a waveform diagram of signals appearing in the device of FIG. 3.

In the following description with regard to the signal waveform diagram of FIG. 4, a high level signal is denoted merely by "H" and a low level signal by "L." If the speech synthesizer controller VC is powered on by an output signal from $R_2$, it is forced into its initial state which is "H" for $CO_8$ of the output port $CO_i$ and the busy signal "H" is supplied from the microprocessor MPU to $N_{INi}$ of the input port $N_{INi}$. In response to the "H" busy signal the controller VC receives the data applied to $N_{IN8}$, lowering $CO_8$ and the ACK signal to "L." Consequently, the busy signal is also lowered. Upon the development of the "L" busy signal the controller VC increases the level of the ACK signal to "H" indicating that it is ready to receive the next succeeding data. In response to the ACK signal assuming "H" level, the processor MPU increases the level of the busy signal to "H" and supplies the second bit data to $N_{IN8}$ of the controller VC. Thougth repeated execution of the above described procedure the total 8-bit word codes are serially transferred to the controller VC. After such transfer of the word codes the busy signal (BSY) remains at the "H" level and the ACK signal remains at the "L" level. Under these circumstances the controller VC starts synthesizing speech. Upon the completion of speech synthesis of these word codes the ACK is raised to the "H" level informing the processor MPU of the completion of the speech synthesis. In reply to this information the processor MPU decreases the BSY signal to the "L" level. This procedure covers from transmission of the group of the word codes to the delivery of speech sound corresonding to that word. The speech synthesizer VC places the word codes into a desired region of the RAM and executes instructions from the control memory depending on information cotained with the sound-related data memory, thus synthesizing sounds corresponding to the successive codes. The abovementioned arrangement is fully disclosed in our earlier U.S. application Ser. No. 220,918 filed on Dec. 29, 1980 specifically incorporated herein by reference.

As stated previously, the present invention provides means for monitoring a supply voltage to a component or components in the sound-related section through the utilization of information control means in the speech synthesizer controller.

Figure 5:
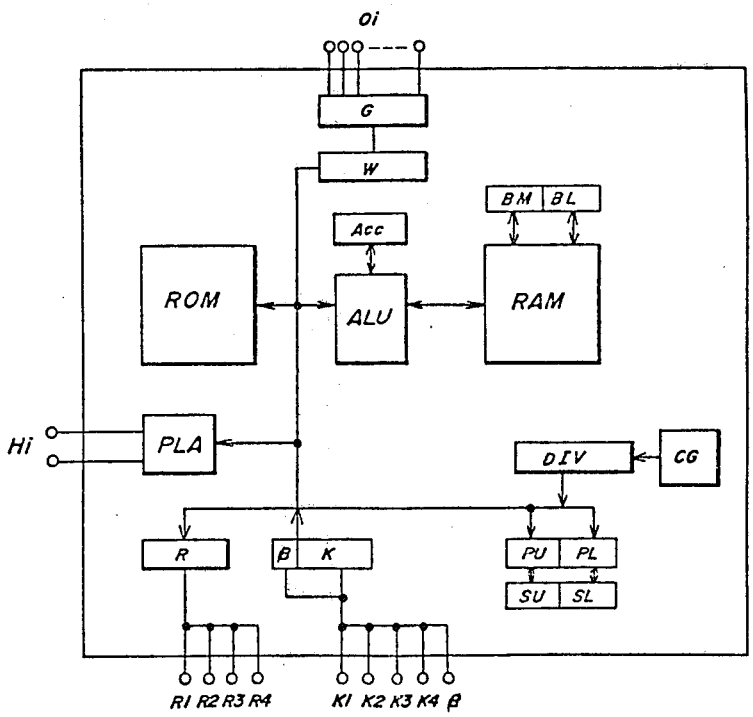
FIG. 5 is a block diagram of a microprocessor to be incorporated into an electronic apparatus in accordance with the present invention.

FIG. 5 is a block diagram showing the processor MPU having the function of a timepiece as an embodiment of the present invention. There are shown a memory ROM for storing a predetermined sequence of instruction codes, a random access memory RAM, an arithmetic logic unit ALU, an accumulator ACC, a display buffer W and an output gate G which provides its output $O_i$ as segment signals for the display. A 4-bit output buffer R supplies data as control signals to the speech synthesizer controller VC via $R_1$, $R_2$, $R_3$ and $R_4$. Input buffers $\beta$ and K receive key signals and the ACK signal. There is further provided program counters PU and PL, stack pointers SU and SL, a clock control CG and a divider DIV.

Figure 6:
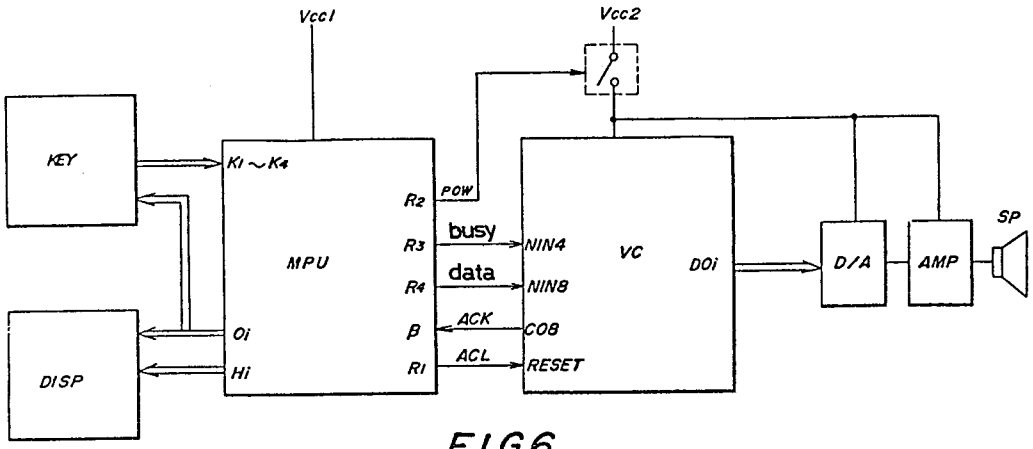
FIG. 6 is a block diagram of the electronic apparatus in accordance with the present invention.

FIG. 6 is a block diagram showing the speech synthesizer controller VC and the microprocessor where the concept of the present invention is applied. This arrangement differs from that of FIG. 3 in that a reset signal ACL is supplied from the microprocessor MPU to the speech synthesizer controller VC and there are provided two different voltage sources $VCC_1$ and $VCC_2$ one of which is a relatively small one for enabling the microprocessor MPU to serve as a timekeeper with a minimum of power consumption and the other of which is a relatively large capacity one for powering the speech synthesizer controller VC. The former $VCC_1$ is always ON to enable the processor MPU to operate as a timekeeper.

Figure 7:
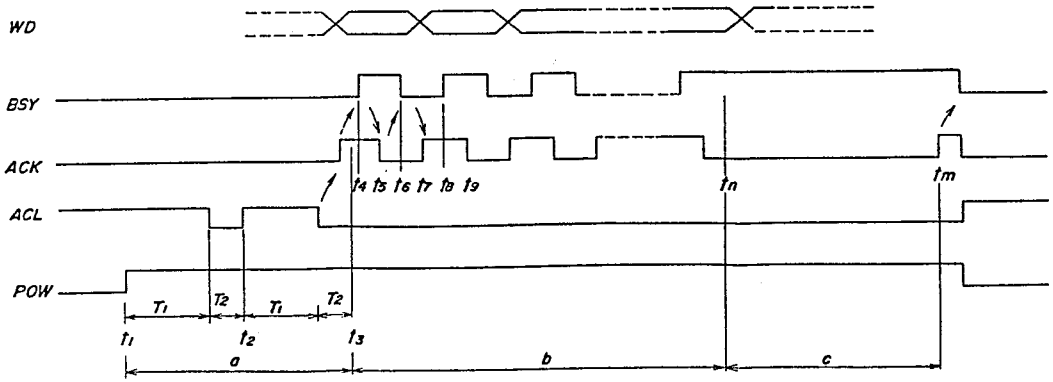
FIG. 7 is a waveform diagram of control signals in the electronic apparatus of FIG. 6.

FIG. 7 depicts the relationship of various signals exchanged between the processor MPU and the speech synthesizer controller VC. The time sequence of FIG. 3 is subdivided into a first period a where an abnormal or erroneous condition in the speech synthesizer controller VC is interrogated in accordance with the present invention, a second period b where the data are transmitted, and a third period c where the audible outputs are delivered. As seen from FIG. 6, when it is desirable to provide an audible output, the output terminal $R_2$ of the processor MPU is first brought up to the "H" level to turn ON the power source for VC at $t_1$. Since the ACL signal is usually at the "H" level, the speech synthesizer controller VC is in the reset state. Upon the lapse of time $T_1$ the ACL signal is set at "L". In other words, the terminal $R_1$ of the processor MPU is at "L". The speech synthesizer controller VC therefore executes one of the stored instructions to thereby hold the output terminal $CO_8$ at "H". Unless it normally operates the speech synthesizer, controller VC latches its output terminal $CO_8$ at "L" with no delivery of the ACK signal. The microprocessor MPU checks if the ACK signal assumes the "H" level upon the passage of $T_2$ after the ACL signal has been decreased to the "L" level. If the ACK signal is "L" at $t_2$ in FIG. 7, then the ACL signal is held "H" for the period of $T_1$. Then, the ACK signal is further checked at a time $t_3$ upon the passage of $T_2$. If the ACK signal is "H", then the processor MPU transfers serially the data WD via the terminal $R_4$.

In the above illustrated embodiment the interrogation as to the ACK signal is repeated up to, for example, 16 times. In the event that the ACK signal still remains at "L", the supply voltage $VCC_2$ to the speech synthesizer controller VC is regarded as being deficient and the ACL signal is forced to the "H" level and a signal POW is forced to the "L" level, thus interrupting the delivery of audible outputs. The reason why the interrogation is repeated a predetermined number of times is as follows. When a power supply source, typically one or more batteries for powering the speech synthesizer controller VC is somewhat exhausted with a corresponding decline of voltage, it takes a long period of time for the supply voltage to reach a predetermined level (suitable for the operation of the speech synthesizer controller VC) after the POW signal from the processor MPU has turned ON the power supply. This tendency is significant especially when the supply voltage is converted through a DC-to-DC converter. To this end the voltage level of the power source is interrogated several times. If the power source has not been depleted at all yet, then the procedure of deliverying audible outputs begins immediately after the power source is thrown ON (the result of the first interrogation permits the ACK signal to assume the "H" level). However, in the case where the power source has been at least partly exhausted, it is some period of time after the power source has been thrown ON that the speech synthesizer begins delivering audible outputs. Once the ACK signal has been determined to be "H" the BSY signal assumes the "H" level ($t_4$) and VC senses such a change and reads the first bit of the word codes WD. Thereafter, the ACK signal is set at "L" ($t_5$). If the BSY signal is set at "L" under these circumstances ($t_6$), the ACK signal is set at "H" ($t_7$) and waits until the BSY signal takes the "H" level. With the BSY signal being "H", the second bit of the word codes is read out ($t_8$). The above procedure is repeated in such a way as to transfer all of the bits of the word codes. For example, where the word codes WD are 8 bits long, transfer is repeated eight times. After the completion of transmission of the 8th bit the processor MPU holds the BSY signal at the "H" level as it is, whereas VC holds the ACK signal at "L" after reading the 8th bit ($t_n$) and then begins the procedure of speech synthesis. After the completion of the audible output indicative of that word, VC permits the ACK signal to assume the "H" level, thus informing the microprocessor MPU of such completion ($t_m$). In response to this, the microprocessor MPU places the BSY signal into the "L" level. In this manner, the speech synthesizer begins deliverying an audible sound indicative of that particular word. When the microprocessor MPU proceeds with the delivery of an audible output of the next succeeding word, it transfers the succeeding word codes in a like manner after confirming the completion of the previous one. If the delivery of all of the word codes is over, then the processor MPU permits the ACL signal to assume "H" and the POW signal to assume "L", thus turning OFF the power supply to speech synthesizer controller VC.

Figure 8:
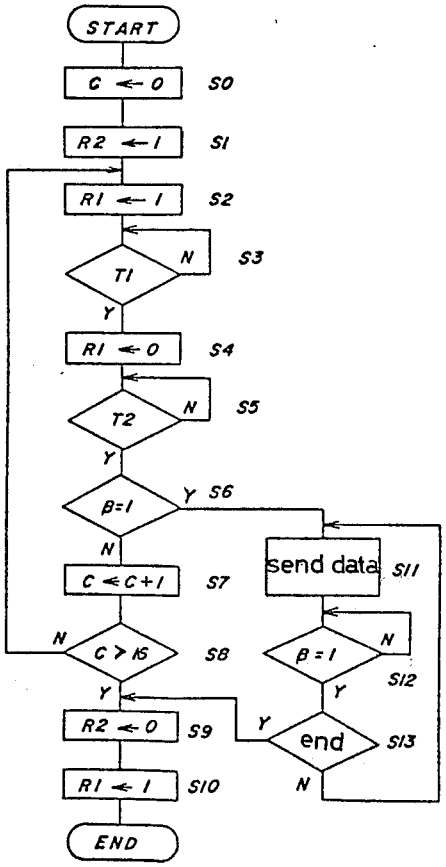
FIG. 8 is a flow chart for explanation of operation of the electronic apparatus.

FIG. 8 shows in a flow chart the sequence of controls on the processor side MPU during the above described operation. When the device is turned ON and it is desirable to provide audible outputs, a counter C is reset and the second and first bits, $R_2$ and $R_1$, of the output buffer R (FIG. 5) in the processor MPU are then set to thereby raise the POW signal and the ACL (reset) signal to the "H" level ($S_0 \rightarrow S_1 \rightarrow S_2$). Upon the lapse of the period $T_1$ the first bit of the output buffer R is reset to lower the ACL signal to the "L" level ($S_3 \rightarrow S_4$) as described above with reference to FIG. 7. Thereafter, whether the input buffer $\beta$ is "H", indicating that the ACK signal is "H" is determined after the passage of the period $T_2$ as also previously described and illustrated in FIG. 7. If the ACK signal is "L" the counter C is incremented ($S_5 \rightarrow S_6 \rightarrow S_7$). The ACK signal may be raised to the "H" level ($S_8 \rightarrow S_2$) only if C is no greater than 15. Should, for example, 16 repetitions of this procedure reveal that the ACK signal remains "L", the speech synthesizer controller VC is regarded as out of order and the power source $VCC_2$ is switched OFF and the ACL signal is increased to the "H" level ($S_8 \rightarrow S_9 \rightarrow S_{10}$). In other words, no audible outputs are delivered. It is to be understood that 16 repetitions of the step of checking the level of the ACK signal is only exemplary. A lesser or greater number of repetitions may be performed to determine if sufficient voltage is provided to raise ACK to "H".

When the ACL signal has been lowered to "L" and the period $T_2$ of time has gone by, it is decided whether the ACK signal is "H" and if so the data are sent to VC ($S_6 \rightarrow S_{11}$) as shown at period b in FIG. 7. This permits the starting of audible outputs. At this moment the ACK signal remains at "L" and assumes the "H" level after the delivery of audible outputs. The processor MPU makes sure that the ACK signal takes the "H" level. The word codes to be audibly outputted are sequentially and continuously transferred in the above-described manner unless the word just delivered is the last word as determined at steps $S_{11}$–$S_{13}$. In this manner, the audible outputs are delivered on a word by word basis. After the delivery of the last word the power supply to the speech synthesizer controller VC is switched OFF and the ACL signal is raised to the "H" level ($S_{13} \rightarrow S_9 \rightarrow S_{10}$). It is noted that the counter C may comprise a specific location of the RAM shown in FIG. 5.

Although in the above embodiment the reset signal is applied externally of the speech synthesizer (i.e., from the processor), the electronic apparatus may be designed such that it is automatically reset when the power supply thereto is switched ON. In this case it is decided whether a reply signal is developed shortly after the power supply has been switched ON.

As noted earlier, the present invention prevents wrong or erroneous outputs from being delivered when the voltage to the speech synthesizer controller falls below a predetermined level. When delivering audible outputs is desirable, it is first decided whether the speech synthesizer controller is out of order (i.e., low voltage). It is only when the negative answer is given (controller working properly) that the speech synthesizer delivers audible outputs. In other words, at the beginning of its operation the speech synthesizer controller first must develop the confirmation signal (ACK) after being reset. Before the delivery of audible outputs the speech synthesizer controller is reset with the ACL signal. An abnormal situation in the speech synthesizer is checked by monitoring the presence or absence of the confirmation signal (ACK signal) after the reset signal has been cleared upon the lapse of a given period of time. In the event that the supply voltage to the speech synthesizer controller declines below that required for normal operation no confirmation signal (ACK signal) is developed so that the speech synthesizer is treated as out of order.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electronic apparatus comprising:

a voltage source;

a speech synthesis controller operatively connected to said voltage source;

said controller comprising means for generating a first signal for facilitating transfer of data to said controller when said controller receives power from said source at at least a threshold voltage level;

data processing means connected to said controller;

said data processing means including means for providing data to said controller in response to receipt of said first signal from said controller;

said data processing means further comprising means for providing a second signal to said controller for determining the state of said first signal, whereby it is determined whether said voltage source is providing power to said controller at at least said threshold voltage level.

2. An apparatus as in claim 1 wherein said data processing means comprises a microprocessor.

3. An apparatus as in claim 1 wherein said speech synthesis controller includes a sound-related data memory and a control memory for storing control instructions.

4. An apparatus as in claim 1 wherein said means for providing a second signal comprises means for repeatedly providing said second signal to said controller, whereby the state of said first signal and the level of said voltage is determined over an extended period of time.

5. An apparatus as in claim 2, wherein said speech synthesizer controller and said microprocessor are implemented with a one-chip LSI device.

* * * * *